US007422675B2

(12) United States Patent
Acker et al.

(10) Patent No.: US 7,422,675 B2
(45) Date of Patent: Sep. 9, 2008

(54) PROCESS FOR CHANGING ANODES IN AN ELECTROLYTIC ALUMINUM PRODUCTION CELL INCLUDING ADJUSTMENT OF THE POSITION OF THE ANODE AND DEVICE FOR IMPLEMENTING THE PROCESS

(75) Inventors: Alain Van Acker, Orchies (FR); Patrick Marchand, Lesquin (FR)

(73) Assignee: E.C.L., Ronchin (FR)

( * ) Notice: Subject to any disclaimer, the term of this patent is extended or adjusted under 35 U.S.C. 154(b) by 357 days.

(21) Appl. No.: 11/212,118

(22) Filed: Aug. 26, 2005

(65) Prior Publication Data

US 2006/0049054 A1 Mar. 9, 2006

Related U.S. Application Data

(60) Provisional application No. 60/607,756, filed on Sep. 8, 2004.

(30) Foreign Application Priority Data

Sep. 8, 2004 (FR) ..... 04 09508

(51) Int. Cl.
*C25C 3/08* (2006.01)
*C25C 3/10* (2006.01)

(52) U.S. Cl. ..... 205/389; 29/709; 29/720; 29/721; 29/729; 29/746; 29/749; 29/757; 29/759; 29/762; 212/175

(58) Field of Classification Search ..... 205/80, 205/81, 96, 389; 29/700, 709, 720, 721, 29/729, 746, 749, 757, 759, 762; 212/175
See application file for complete search history.

(56) References Cited

U.S. PATENT DOCUMENTS 4,032,020 A * 6/1977 Kato et al. ..... 414/586
4,221,641 A 9/1980 Weber
4,540,474 A 9/1985 Voegel
5,435,897 A * 7/1995 Zannini ..... 204/245
6,136,177 A * 10/2000 Hung ..... 205/336
7,001,497 B2 * 2/2006 Gagne et al. ..... 205/81
2004/0211663 A1 10/2004 Gagne et al.

FOREIGN PATENT DOCUMENTS

EP 324266 7/1989
WO 2005/052217 6/2005

OTHER PUBLICATIONS

Bouchard et al, "New apparatus for automatic positioning and replacement of anodes," Aluminium, 80:7-8, pp. 820-822 (2004), no month available.

* cited by examiner

*Primary Examiner*—Bruce F Bell
(74) *Attorney, Agent, or Firm*—Dennison, Schultz & MacDonald

(57) ABSTRACT

A process for changing an anode of a cell for the production of aluminum by fused bath electrolysis including a plurality of anodes. According to the invention, an anode handling tool is used including a positioning device, a gripping device and a sensor detecting the vertical position of the gripping device, and the position sensor is used to measure the vertical distances traveled by the gripping device with respect to a reference level N. At least one sound or electromagnetic waves beam is then produced in a determined reference line or plane and the passage of the anode in the beam is used to measure the distances. The vertical position of the replacement anode in the cell is determined starting from the values obtained for the traveled distances and the replacement anode is put into this position in the place initially occupied by the spent anode.

21 Claims, 6 Drawing Sheets

PROCESS FOR CHANGING ANODES IN AN ELECTROLYTIC ALUMINUM PRODUCTION CELL INCLUDING ADJUSTMENT OF THE POSITION OF THE ANODE AND DEVICE FOR IMPLEMENTING THE PROCESS

This application claims the benefit of U.S. provisional application Ser. No. 60/607,756, filed Sep. 8, 2004.

FIELD OF THE INVENTION

The invention relates to the Hall Heroult process for the production of aluminum by fused bath electrolysis. It is more particularly related to anode changes and tending assemblies designed to make anode changes in production plants.

BACKGROUND OF RELATED ART

Aluminum is produced industrially by fused bath electrolysis in electrolytic cells according to the well-known Hall-Héroult process. French patent application FR 2 806 742 (corresponding to patent U.S. Pat. No. 6 409 894) describes installations of an electrolysis plant intended for the production of aluminum.

With the most widespread technology, electrolytic cells are provided with a plurality of "prebaked" anodes made of a carbonaceous material that are consumed during electrolytic reduction reactions of aluminum. The progressive consumption of anodes requires work on the electrolytic cells, particularly including the replacement of spent anodes by new anodes.

When changing an anode, in order to limit disturbance to the operation of an electrolytic cell, it is preferable to put the new anode into place such that its lower surface is at the same level as the other anodes in the cell.

It is known that it is possible to proceed as described below to determine the level of new anodes correctly. The rod of the spent anode is marked with a chalk-line at a location corresponding to a determined mark on the anode frame. The spent anode is extracted from the cell and is put down on a reference surface, typically a metallic plate. The level of the chalk-line on the rod is recorded, the spent anode is withdrawn, and a new anode is put into place on the reference surface. A chalk-line is drawn on the rod of the new anode at the recorded level. The new anode is put into place on the anode frame such that the chalk-line is at the same level as the determined mark on the anode frame. These essentially manual operations require action by an operator in the area in which the anode handling tools are being used, and expose the operator to the risks inherent to these operations such as risks of the load becoming detached, or liquid metal splashes.

It is also known that the anode handling tool can be fitted with a position sensor. In this case, the distance traveled by the tool when the spent anode being picked up is measured, the spent anode is put down on a reference surface, and the distance traveled by the tool at the time that the anode is supported on the reference surface is measured. The spent anode is withdrawn, a new anode is placed on the reference surface, and the distance traveled by the tool at the time that the anode is supported on the reference surface is measured. The difference between the last two measured distances is added to the first measured distance to determine the remaining distance that the handling tool should travel when the new anode is put into position in the electrolytic cell.

These different manners of working require multiple anode manipulations and displacement of the reference surface from one working area to another. The time spent on these operations considerably lengthens the durations of working cycles on electrolytic cells and the time period during which the hoods of pots remain open, which reduces the efficiency of collection means for effluents produced by electrolytic cells.

Therefore the applicant searched for a procedure and means of avoiding these disadvantages.

SUMMARY OF THE INVENTION

An object of the invention is a process for changing an anode of a cell for the production of aluminum by fused bath electrolysis comprising a plurality of anodes, the cell containing an electrolytic bath and comprising at least one cathode block, each anode comprising at least one anode block and a metal rod and being fixed removably by mechanical attachment means to a mobile metal frame, each anode block having a reference surface, wherein at least one determined spent anode is replaced by a replacement anode using at least one anode handling tool comprising a positioning device, a gripping device and a sensor to determine the vertical position of the gripping device, and wherein the position sensor of the anode handling tool or each anode handling tool is used to measure the vertical distances traveled by the gripping device or each gripping device relative to a reference level N, characterized in that at least one beam of sound or electromagnetic waves is produced along a determined reference line or in a determined reference plane, and in that for each determined spent anode:

a gripping device is placed in the gripping position of the metal rod of the spent anode, and the vertical distance A traveled by the gripping device to reach the position is measured;

the spent anode is withdrawn from the electrolytic cell, the anode block of this anode is passed through the beam in a vertical movement and the vertical distance B traveled by the gripping device at the moment at which the reference surface of this anode passes through the beam is measured;

the metal rod of a replacement anode is gripped using a gripping device, the anode block of this anode is passed through the beam in a vertical movement and the vertical distance C traveled by the gripping device at the moment at which the reference surface of this anode passes through the beam is measured;

the vertical position of the replacement anode in the cell is determined starting from values obtained for the traveled distances A, B and C, and the replacement anode is put into this position in the place initially occupied by the spent anode.

The invention allows for the measurements necessary for the positioning of a replacement anode to be made during the handling movements that are necessary for the replacement of an anode (that is, typically, taking a spent anode from an electrolysis cell, depositing the spent anode on a pallet or a vehicle, taking a replacement anode from a pallet or a vehicle and placing the replacement anode in the cell), which is advantageous in that it does not require additional handling movements. The invention makes it possible, in particular, to avoid lengthening the duration of the opening of an electrolysis cell.

The beam or beams of sound waves or electromagnetic waves are advantageously placed, beforehand, in a location that enables a spent anode or a replacement anode to pass through the beam or beams during the normal handling movements of these anodes, for example above an electrolysis cell, above a pallet or above a vehicle.

The measurements may be taken manually, i.e. an operator records the data obtained at each step of the process, or in a partly or totally automated way, i.e. a computerized apparatus takes all or part of the measurements in an automated way.

Another object of the invention is a measurement system comprising a position sensor to measure vertical distances traveled by an anode gripping device, a beam generator for generating sound or electromagnetic waves capable of generating at least one beam of sound or electromagnetic waves along a determined reference line or in a determined reference plane, at least one sound or electromagnetic wave detector capable of detecting the passage of a determined part of an anode through the beam and at least one positioning device to which the generator and/or the detector is fixed.

Another object of the invention is a tending machine intended for anode replacement operations in a series of cells for the production of aluminum by fused bath electrolysis, the machine comprising at least one anode handling tool comprising a positioning device, a gripping device and a sensor to determine the vertical position of the gripping device, and being characterized in that it further comprises the measurement system.

Another object of the invention is a tending assembly for a plant for the production of aluminum by fused bath electrolysis comprising a traveling crane and at least one tending machine according to the invention.

BRIEF DESCRIPTION OF THE DRAWINGS

The invention is described in more detail in the following with reference to the attached Figures.

DESCRIPTION OF THE PREFERRED EMBODIMENTS

Figure 1:
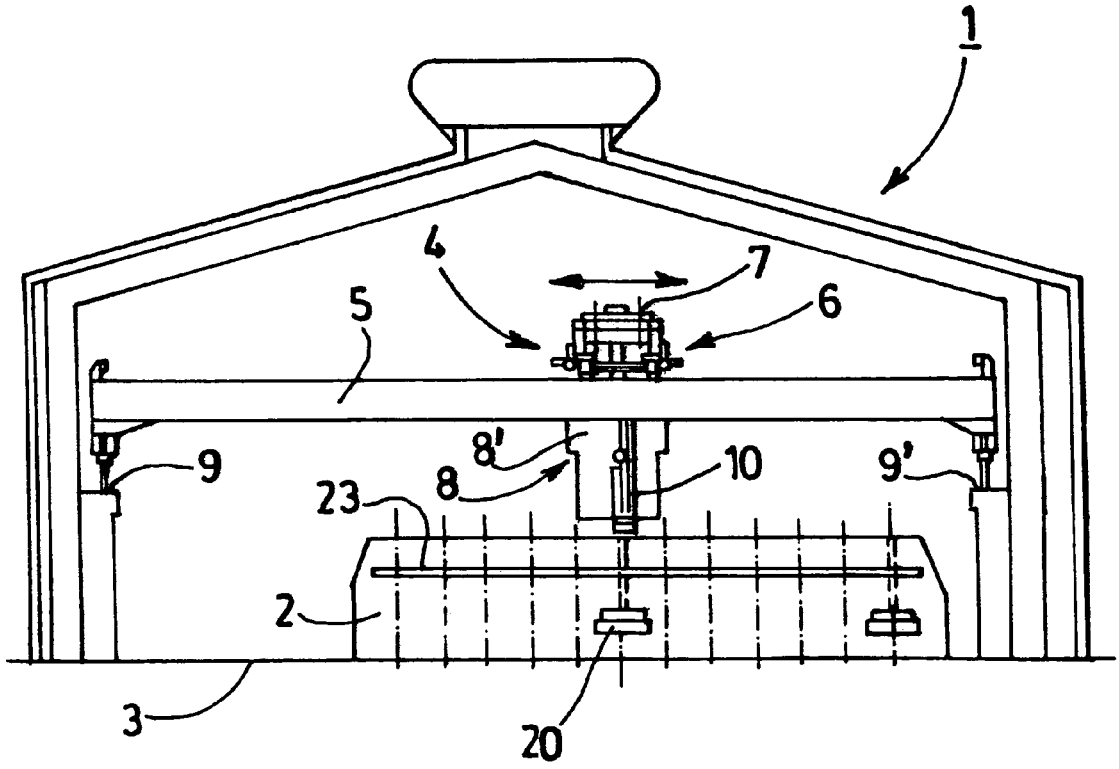
FIG. 1 is a sectional view illustrating a typical potroom intended for the production of aluminum and comprising a diagrammatically shown tending assembly.

Electrolytic plants for the production of aluminum comprise a liquid aluminum production area that comprises one or several potrooms (1). As illustrated in FIG. 1, each potroom (1) comprises electrolytic cells (2) and at least one tending assembly (4). The tending assemblies are often called Pot Tending Assemblies (PTA) or Pot Tending Machines.

The electrolytic cells (2) are normally arranged in rows or lines, each row or line typically comprising more than a hundred cells, electrically connected in series by connecting conductors. The cells (2) are arranged so as to leave circulation aisles (3) between the cells and along the potroom (1).

Figure 2:
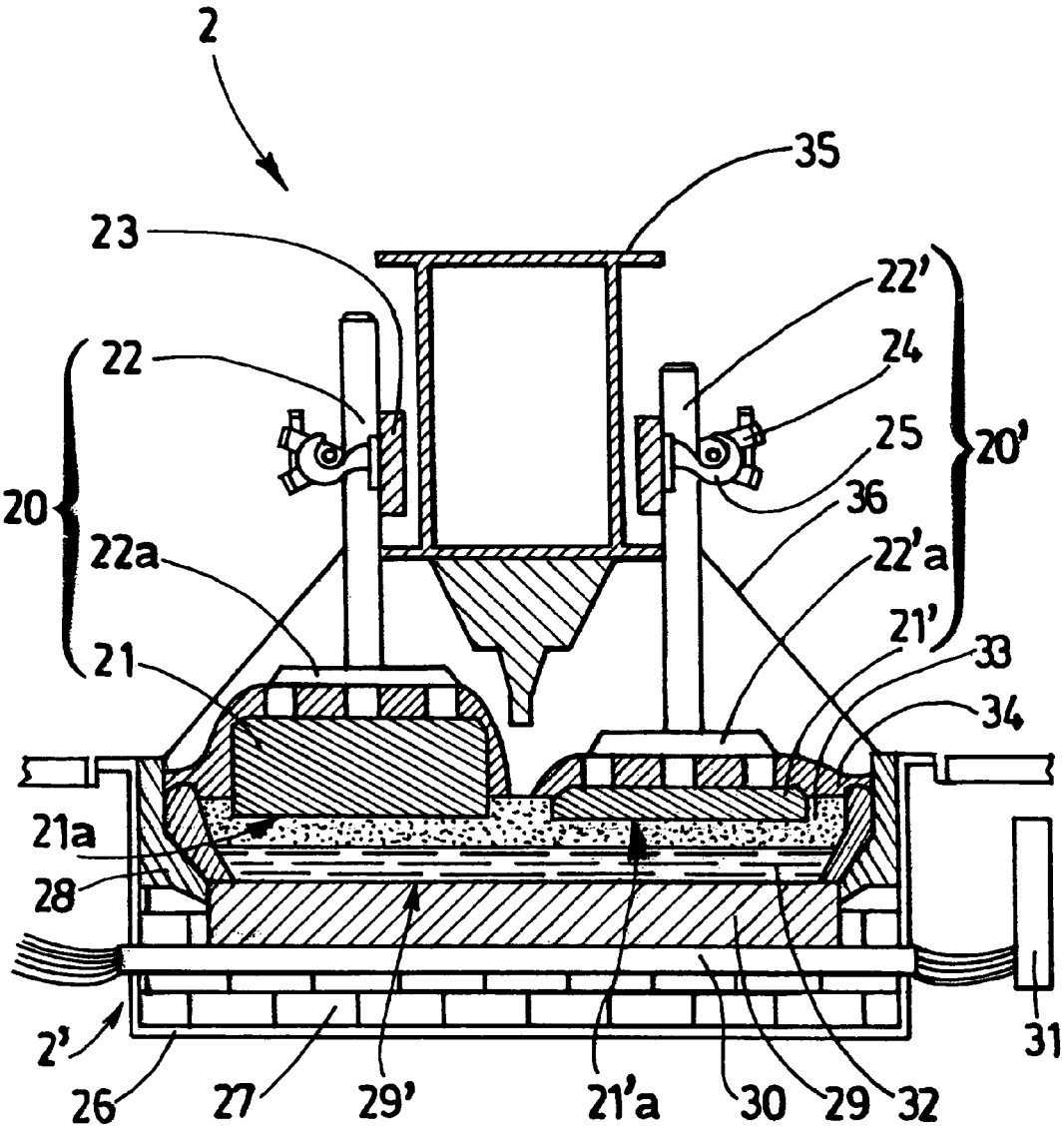
FIG. 2 is a cross-sectional view illustrating a typical electrolytic cell intended for the production of aluminum.

As illustrated in FIG. 2, each electrolytic cell (2) comprises a pot (2'), a support structure (35) called the "superstructure" and a plurality of anodes (20, 20'). The pot (2') comprises a steel pot shell (26), an inner lining (27, 28) that is generally formed by blocks made of refractory materials, and a cathode assembly (29, 30) that includes blocks made of a carbonaceous material (29) called "cathode blocks", and metal connection bars (30) to which the electrical conductors (31) that carry the electrolysis current are attached. The anodes (20, 20') comprise at least one anode block (21, 21') made of a prebaked carbonaceous material and a metal rod (22, 22'). The anode blocks (21, 21') are typically parallelepiped shaped. The rod (22, 22') is typically fixed to the anode block(s) (21, 21') through an attachment element (22*a*, 22*a'*), generally called a "multipode" that is anchored to the anode blocks (typically using cast iron). The anodes (20, 20') are fixed removably to a metal frame (23) called the "anode frame" by mechanical attachment means (24, 25), typically including a connector (24) and hooks (25). The mobile frame (23) is supported by the superstructure (35) and is fixed to electrical conductors (not shown) used to carry the electrolysis current.

An electrolytic cell (2) generally comprises a hooding system (36), typically comprising a series of hoods, to confine effluents inside the cell, and means (not illustrated) of evacuating the effluents towards a treatment centre.

The inner lining (27, 28) and the cathode blocks (29) form a crucible inside the pot (2'), capable of containing the electrolytic bath (33) and a pad of liquid metal (32) when the cell is in operation. In general, a blanket of alumina and solidified bath (34) covers the electrolytic bath and some or all of the anodes.

The anodes (20, 20'), and more precisely the anode blocks (21, 21') are partially immersed in the electrolytic bath (33) that contains dissolved alumina. The lower surface (21*a*, 21*a'*) of the anodes is typically essentially plane and parallel to the upper surface (29') of the cathode blocks (29) that is generally horizontal. The distance between the lower surface of the anodes and the upper surface of the cathode blocks is called the "anode-cathode distance" and is an important parameter in the regulation of electrolytic cells. The anode-cathode distance is usually controlled very precisely.

The anode blocks (21, 21') are progressively consumed during use. Routine practice consists of progressively lowering the anodes (20, 20'), by moving the mobile frame (23) uniformly downwards in order to compensate for this wear. Furthermore, as illustrated in FIG. 2, the anode blocks (21, 21') usually have different degrees of wear. Consequently, the position of the replacement anode (20") usually called the "new anode", relative to the mobile frame (23), is generally adjusted every time that the anode is replaced. More precisely, the position of the anodes is adjusted so as to bring the so-called "lower" surface (21*a*, 21*a'*, 21*a"*) of the anode blocks (21, 21', 21") (i.e. the surface of the anode blocks that will be immersed in the electrolytic bath (33) contained in the electrolytic cell (2) and parallel to the upper surface (29') of the cathode block(s) (29)) into a same plane. In practice, the replacement anode (20") is placed such that when its operating temperature has been reached, its lower surface (21*a"*) is located at the same level as the lower surface (21*a'*) of the spent anode (20') that it is replacing. The lower surface (21*a*, 21*a'*, 21*a"*) of the anode blocks (21, 21', 21") is usually essentially plane.

The tending assembly (4) is used to perform operations on cells (2) such as anode changes or filling of electrolytic cell feed hoppers with crushed bath and $AlF_3$. It can also be used to handle various loads, such as pot elements, liquid metal ladles or anodes.

Figure 3:
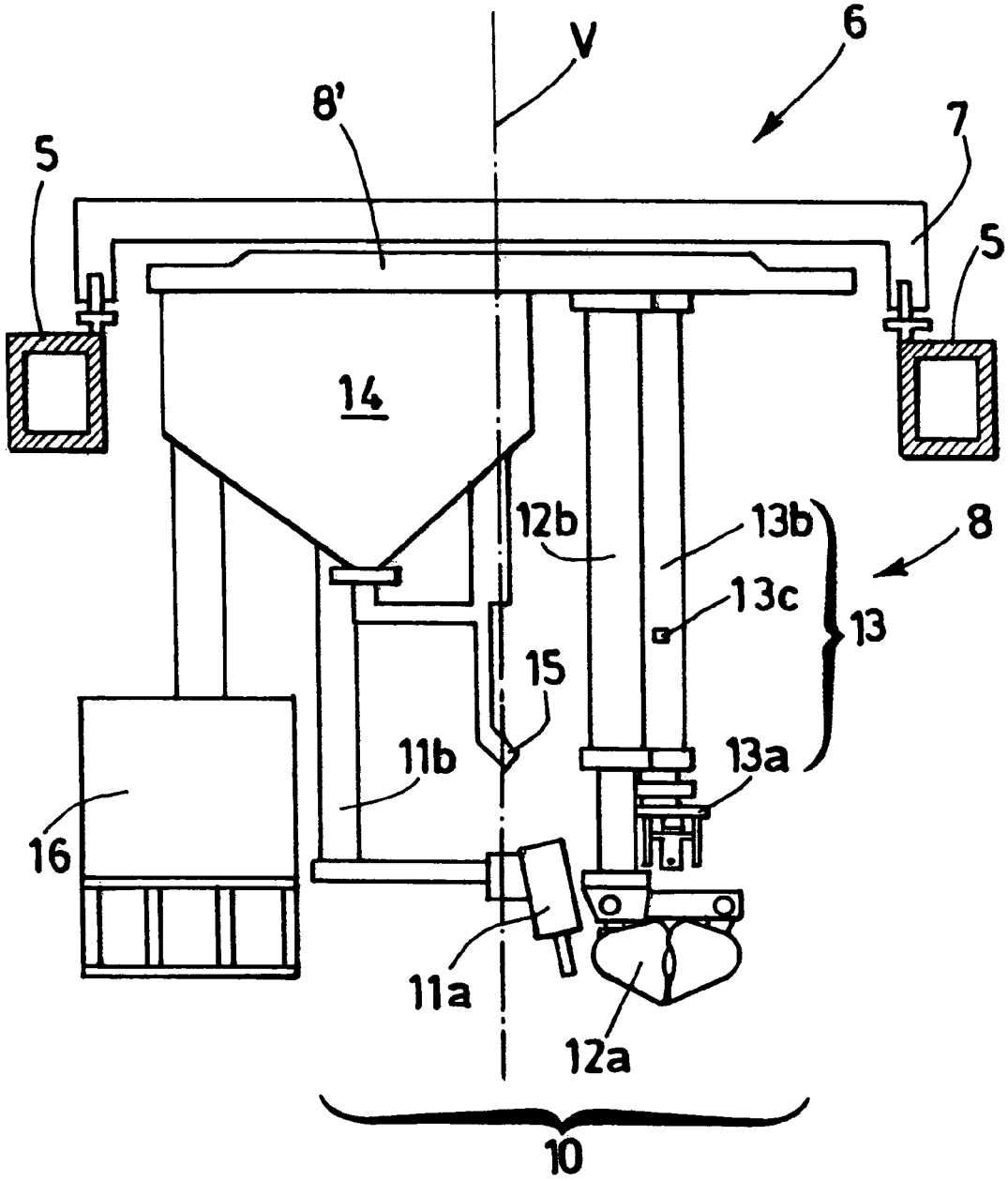
FIG. 3 diagrammatically shows a side view of a tending machine.

The tending assembly (4) as illustrated in FIGS. 1 to 3 comprises a traveling crane (5) that can be moved longitudinally above the electrolytic cells (2) and a tending machine (6). The tending machine (6) comprises a mobile trolley (7) and a tending module (8) equipped with several handling and work devices (10) such as tools (shovels, wrenches, crust-breakers, etc.). The tending module (8) as illustrated in FIG. 3 typically comprises a turret (8') mounted on the trolley (7) so that it can pivot about a vertical axis V during use. The handling and working devices (10) are typically fixed to the turret. The tending module (8) may also comprise a control cab (16) for operators. The traveling crane (5) is supported on and circulates on running tracks (9, 9') arranged parallel to each other and to the main axis of the hall (and the row of cells). The travelling crane (5) can thus move along the entire length of the potroom. The trolley (7) can move along the length of the travelling crane (5).

As illustrated in FIG. 3, the tending machines (6) used for anode replacement operations are equipped with a determined set of tools (10), namely typically a crustbreaker (11*a*), a bucket shovel (12*a*), an anode gripping device (called an "anode clamp") (13*a*) and a hopper (14) fitted with a retractable duct (15). The crustbreaker (11*a*) is used to break the alumina crust and the solidified bath (34) that usually covers all or some of the anodes in the cell; the bucket shovel (12*a*) is used to clear the position of the anode after the spent anode has been removed, by the removal of solid matters (such as pieces of crust and alumina) in this location; the anode clamp (13*a*) is used to grip and manipulate anodes by their rod, particularly to remove spent anodes from an electrolytic cell and to put new anodes into the electrolytic cell; the retractable duct (15) is used to introduce alumina and/or crushed bath into the electrolytic cell so as to form a coating layer after a new anode has been put into place. The crustbreaker (11*a*), the bucket shovel (12*a*) and the anode clamp (13*a*) are typically installed at the lower end of a positioning device (11*b*, 12*b*, 13*b*) such as a telescopic mast or arm. The expression "anode handling tool" (13) denotes the assembly comprising an anode gripping device (13*a*) and a positioning device (13*b*).

For implementation of the invention, the tending machine (6) comprises at least an anode handling tool (13) fitted with a positioning device (13*b*), a gripping device (13*a*) and a sensor (13*c*) to determine the vertical position of the gripping device.

The process for changing an anode in a cell (2) for the production of aluminum by electrolysis comprising a plurality of anodes (20, 20') typically includes the following basic steps:

a tending machine is placed close to the determined spent anode (20');

the hoods (36) located close to the spent anode (20') are removed;

the mobile frame (23) to which the anodes (20, 20') are fixed is immobilized;

the metal rod of the spent anode (20') is gripped using an anode handling tool (13), and more precisely using a gripping device (13*a*);

the mechanical attachment (24) of the spent anode is detached;

the spent anode (20') is removed from the electrolytic cell using the handling tool (13);

the spent anode (20') is put down in a specific location;

a replacement anode (20") is gripped using a handling tool (13), usually the same tool as that used for handling the spent anode;

a vertical position for the replacement anode (20") is determined;

the replacement anode (20") is put into the determined vertical position in the space initially occupied by the spent anode;

the replacement anode (20") is fixed on the mobile frame (23) using a mechanical attachment means.

According to the invention, a vertical position for the replacement anode (20") is determined using measurements made while handling the anodes. These measurements relate firstly to the position of the anode handling tool, and secondly to the anodes passing through a determined line or a determined plane outside the electrolytic cell. This is done by firstly creating a virtual reference line or reference plane delimited by sound or electromagnetic waves, and passage of the anodes through this line or this plane is detected using a system for detection of sound or electromagnetic waves. An anode handling tool (13) comprising a sensor (13*c*) for detecting the vertical position of the gripping tool (13*a*) is also used, and displacements of the gripping device during anode handling operations are measured. The vertical position of the replacement anode is determined using measurements of the displacement of the gripping device at determined moments, namely when the spent anode is gripped, when the spent anode passes through the determined line or plane, and when the replacement anode passes through the determined line or plane.

Figure 4:
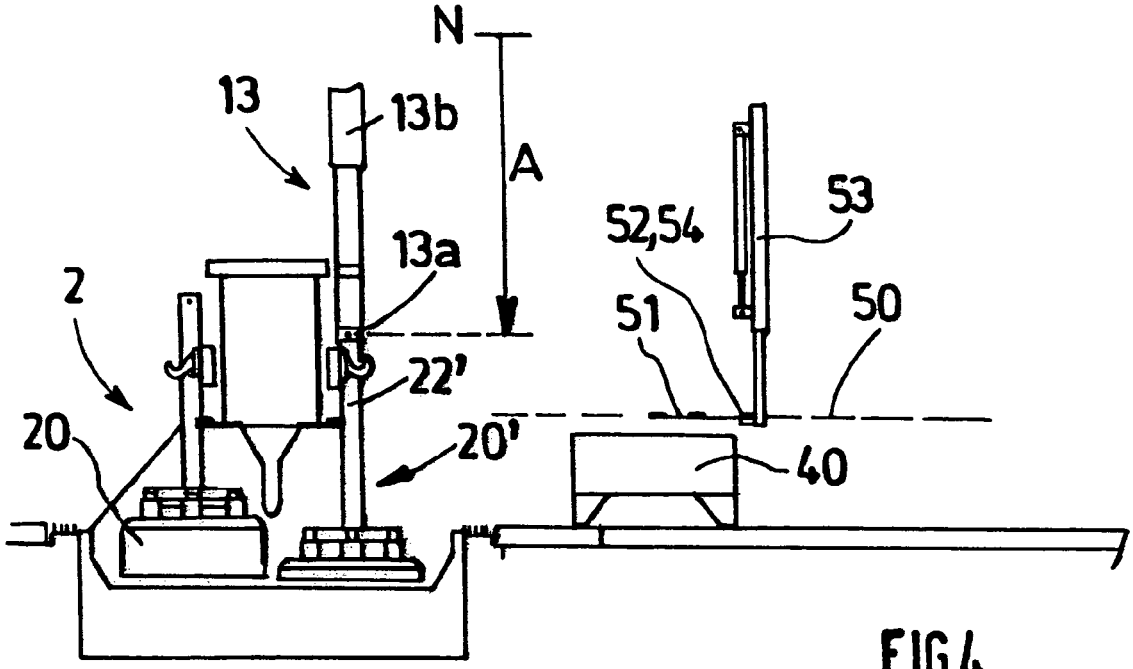
FIGS. 4 to 7 illustrate an embodiment of the anode replacement process according to the invention.
Figure 5:
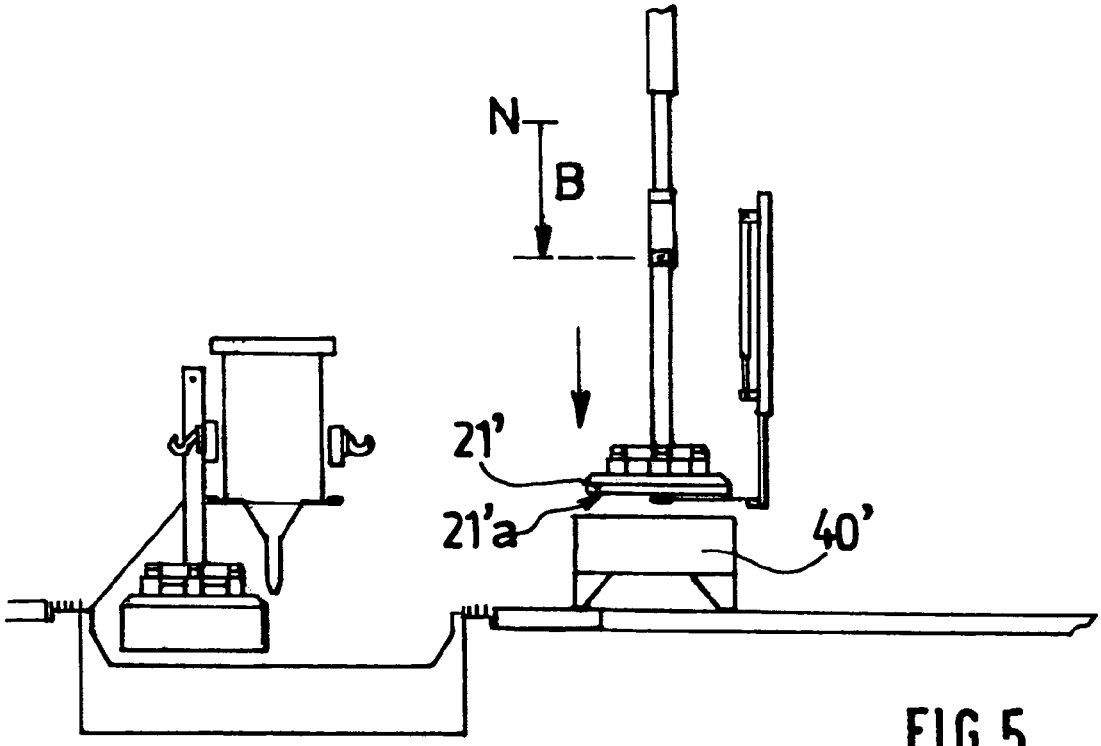
Figure 6:
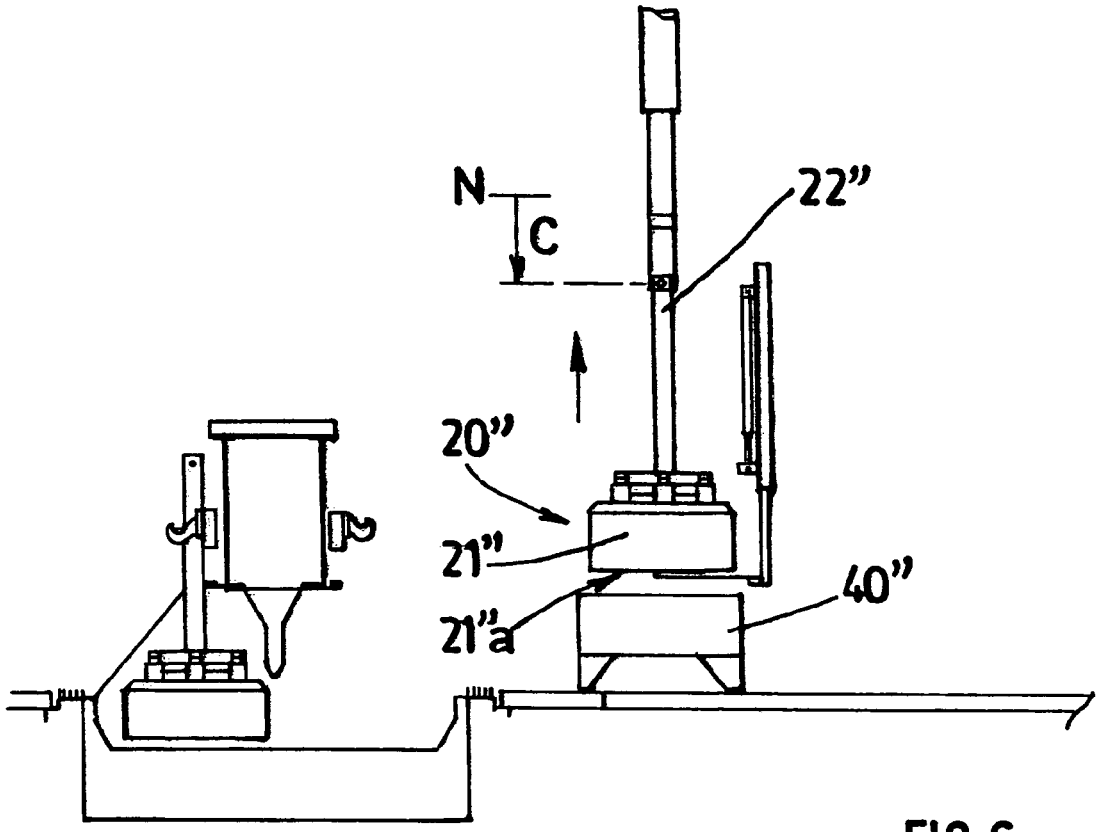
Figure 7:
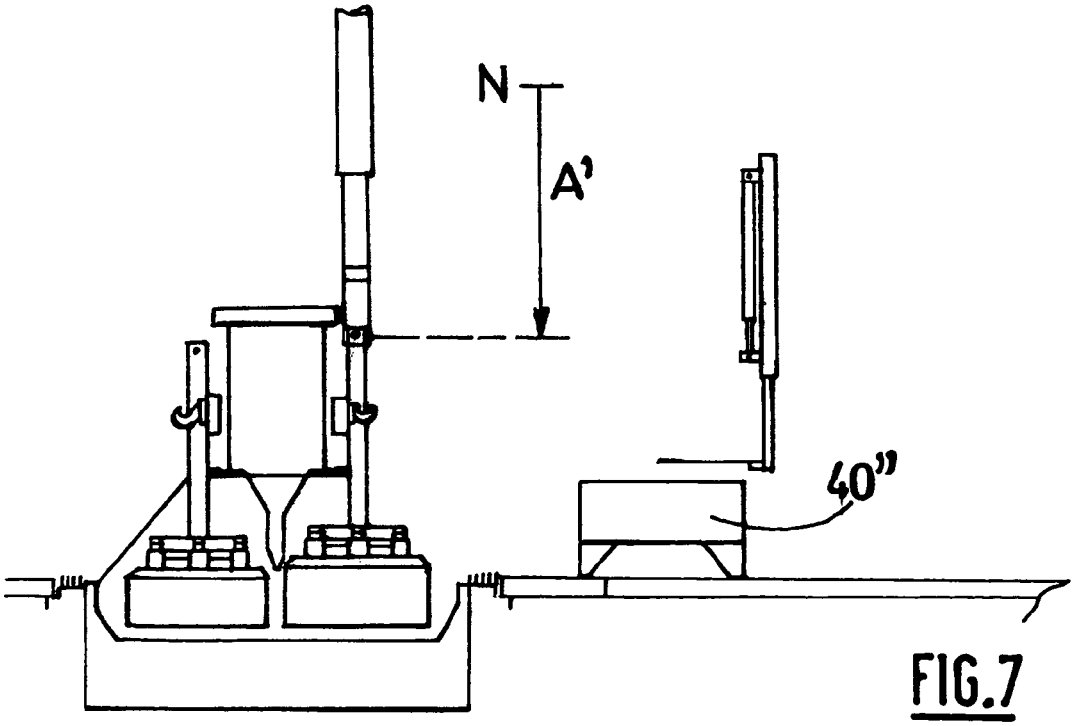

For the embodiments of the invention illustrated in FIGS. 4 to 7, the process is as follows:

at least one beam of sound or electromagnetic waves (51) is produced along a determined reference line or in a determined reference plane (50) (FIG. 4);

an anode handling tool (13) is put into position, comprising a sensor (13*c*) detecting the vertical position of the gripping device (13*a*) at a determined spent anode (20') and a gripping device (13*a*) is put into position to grip the metal rod (22') of this anode (20') (FIG. 4);

the metal rod (22') of a determined spent anode (20') is gripped using the gripping device (13*a*) of an anode handling tool (13) and a first vertical distance A traveled by the gripping device is measured using the position sensor (FIG. 4);

the mechanical attachment (24) of the spent anode (20') is released, the spent anode (20') is withdrawn from the electrolytic cell using the handling tool (13), the anode block(s) (21') of this anode are passed through the beam in a vertical movement, and the position sensor is used to measure a second vertical distance B traveled by the gripping device at the moment at which the reference surface (21*a*') of the anode passes through the beam (FIG. 5);

the metal rod (22") of a replacement anode (20") is gripped using a gripping device (13*a*), the anode block(s) (21") of this anode is (are) passed through the beam in a vertical movement, and the position sensor is used to measure a third vertical distance C traveled by the gripping device at the time at which the reference surface (21*a*") of the anode passes through the beam (FIG. 6);

the vertical position of the replacement anode (20") in the cell is determined starting from values obtained for the first, second and third distances traveled (A, B and C) and the replacement anode (20") is put into this vertical position at the location initially occupied by the spent anode (FIG. 7);

the replacement anode (20") is fixed on the mobile frame (23) using a mechanical attachment means (24).

The distance measurements may be made during normal spent anode replacement manipulations. The invention can thus significantly limit handling operations required to determine the position of the replacement anode.

The same gripping device (13*a*) is preferably used to handle a determined spent anode (20') and the replacement anode (20") that will replace it. This variant avoids calibration of separate tool sensors and differences in distance measurements inherent to the use of separate tools. In this case, the spent anode (20') is put down in a determined location before the metal rod (22") of the replacement anode (20") is gripped with the gripping device (13*a*).

The first distance (A) can be measured before or after the rod (22') of the spent anode (20') is gripped. This distance is preferably measured after gripping the rod (22') of the spent anode (20') and after putting the handling tool (13) under mechanical tension, so as to take up the mechanical play and improve the accuracy of the measurement.

The reference surface (21*a*, 21*a*', 21*a*") of the anodes is preferably the so-called "lower" surface of the anode block(s) (21, 21', 21").

The vertical distance B is preferably measured during a downwards movement of a spent anode (20'), typically during deposition of the anode in the determined location, which is usually a pallet or a vehicle (40, 40') that will be used to take it away, so as to limit anode handling movements. This is achieved by positioning the beam at a determined height above the determined location.

The vertical distance C is preferably measured during an upwards movement of a replacement anode (20"), typically during removal of the anode from a temporary storage location, which is usually a pallet or a vehicle (40, 40") that will be used to bring it into place, so as to limit anode handling movements. This is achieved by positioning the beam at a determined height above the storage location.

The vertical position of a replacement anode (20") corresponds to a vertical distance A' traveled by the gripping device (13*a*) when the replacement anode is put into place in the location initially occupied by a determined spent anode. In practice, when the replacement anode is put into place, the lowering movement of the gripping device is stopped when the distance traveled by the gripping device is equal to A'. The vertical distance A' is typically given by the relation A'=A−B+C+D, where D is a correction term to take account of the replacement anode reaching its normal operating rate in the cell.

According to one embodiment of the process according to the invention, the spent anodes (20') are replaced one by one by replacement anodes (20").

According to another embodiment of the process according to the invention, at least two spent anodes (20') are replaced at the same time by the replacement anodes (20"). In this case, the distances A, B and C are measured and the distance A' is determined for each of the spent anode (20')/replacement anode (20") pairs. This embodiment of the invention is advantageously implemented using a tending machine (6) comprising a number of anode handling tools (13) equal to at least the number of spent anodes that are replaced simultaneously.

The position sensor (13*c*) is used to measure the distance traveled vertically by the gripping device (13*a*) during anode handling operations. Distances are given with respect to a reference level N that may be arbitrary. The reference level N is preferably the same for all distance measurements during the same anode change in order to simplify calculations and not introduce uncertainties in the determination of the final position of the replacement anode.

For example, the position sensor (13*c*) may be a cable encoder or a laser telemeter. The position sensor is advantageously integrated into the anode handling tool (13). Typically, the position sensor (13*c*) is rigidly fixed to the fixed part of the positioning device (13*b*) of the anode handling tool (13); it is used to measure the relative distance from a determined point fixed to the gripping device. For example, the position sensor may be fixed to the sliding part of a telescopic arm or mast to which the gripping device is fixed.

In order to compensate for any clearances between the components of the anode handling tool (13) and between the anode gripping device (13*a*) and an anode rod (22, 22'), it is advantageous to make the first traveled distance measurement A in tension, in other words after tensioning the kinematic part of the tool (before loosening the connector (24) that holds the anode rod in position on the mobile frame (23)), since the other distance measurements are made in tension within the context of the invention (the reference line or plane being virtual and the replacement anode being suspended from the gripping device when its position is adjusted in the cell). It is advantageous that the anode handling tool (13) should be provided with a means of measuring the tension in the tool, such as an axial dynamometer, to determine the moment at which the kinematic part of the tool is in tension and to determine the moment at which the mechanical clearances are all corrected in the same direction, so as to take account of the clearances.

The sound waves are typically ultrasound waves.

The electromagnetic waves are typically visible light, infrared or radio waves. It is advantageous to generate the beam (51) using a laser.

The lower surface (21*a*, 21*a*', 21*a*") of the anodes, especially the spent anodes, may have irregularities coming, in particular, from surface defects, uneven wear of the anodes or deposits of matter (such as alumina) during the use of the anodes. In order to avoid making distorted measurements of the distance traveled caused by irregularities in the reference surface (21*a*, 21*a*', 21*a*"), two or several (typically three) beams of sound or electromagnetic waves (51) are preferably generated so as to form a determined reference plane (50). This variant of the invention is typically implemented using a generator comprising two or several sound or electromagnetic wave sources, in other words each beam (51) is generated by a distinct wave source (in the case of electromagnetic waves, each source is typically a laser). In this variant, the distances traveled (B and C) are advantageously given by the average of the distances traveled measured for each beam (possibly after having eliminated one or more values that are considered to be aberrant).

The determined reference line or determined reference plane (50) is preferably substantially horizontal. The angle between the horizontal and said reference line or plane (50) is preferably smaller than about 10, and more preferably smaller than about 5.

Figure 8:
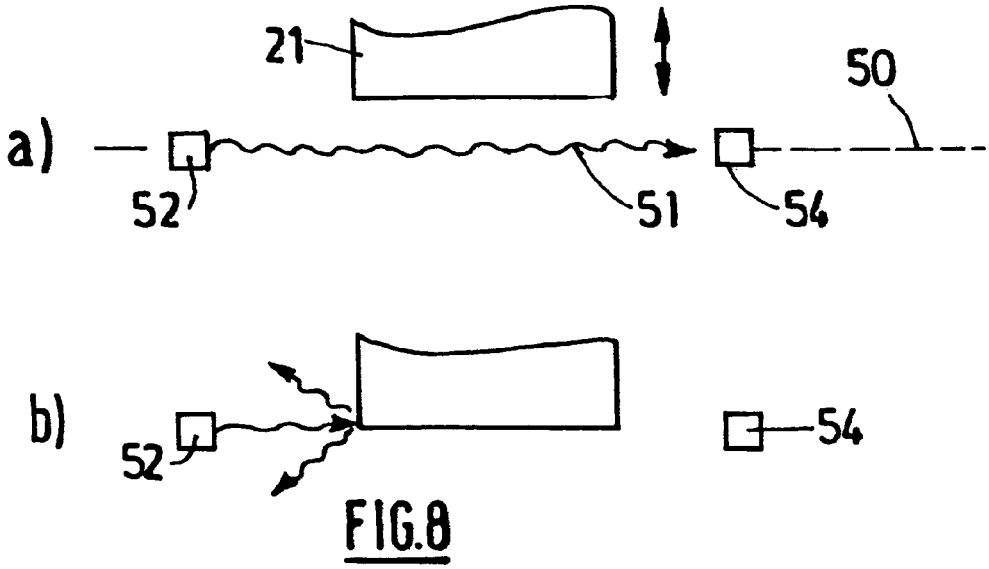
FIGS. 8 to 10 diagrammatically show embodiments of the means for detecting the position of an anode according to the invention.

The moment at which the reference surface (21*a*', 21*a*") of an anode passes through the beam may be determined in different manners. According to one advantageous manner of proceeding that can be easily computerized, a sound or electromagnetic wave generator (or emitter) is used to produce the beam and a detector (or receiver) is used to detect the beam. According to a first embodiment of this manner of proceeding that is shown diagrammatically in FIG. 8, a sound or electromagnetic wave detector (54) is placed facing a sound or electromagnetic waves beam generator (52) such that the detector can detect the beam produced by the generator (FIG. 8*a*). The moment at which the reference surface (21*a*', 21*a*") of an anode (20', 20") passes through the beam is detected when the anode block (21', 21") interrupts transmission of the beam to the detector (FIG. 8*b*).

Figure 9:
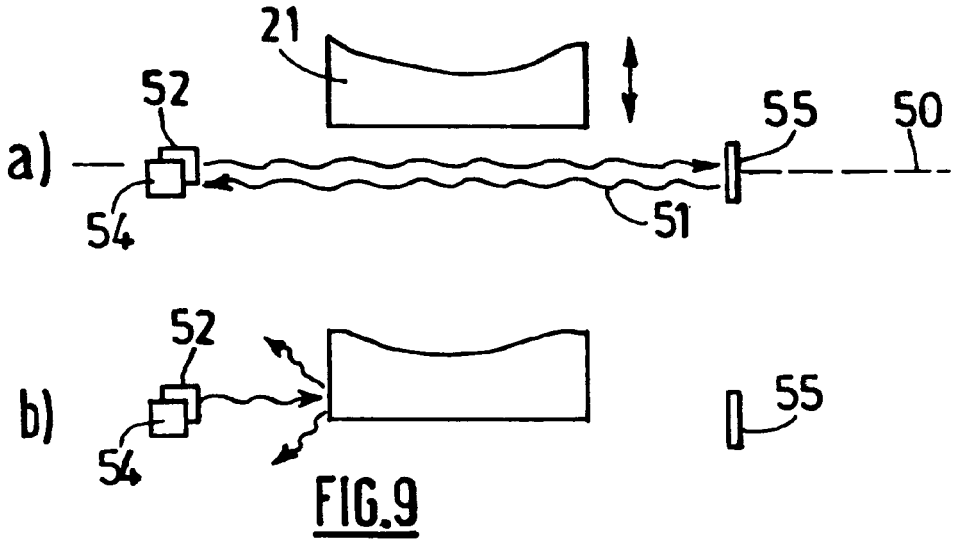

According to another embodiment of this manner of proceeding that is shown diagrammatically in FIG. 9, a sound or electromagnetic wave detector (54) and a sound or electromagnetic waves beam generator (52) are placed facing a reflecting surface (55) such as a mirror, such that the detector can detect the beam produced by the generator and reflected by the reflecting surface (55) (FIG. 9*a*). These elements may be arranged in a triangle so as to form a plane. The moment at which the reference surface (21*a*', 21*a*") of an anode (20', 20") passes through the beam is detected when the anode block (21', 21") interrupts the transmission of the beam to the detector (FIG. 9*b*).

Figure 10:
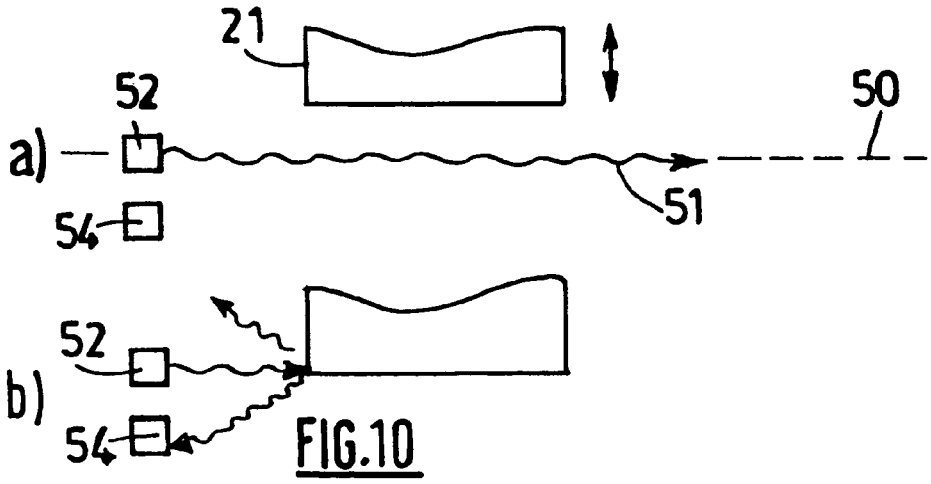

According to yet another embodiment of this manner of proceeding that is shown diagrammatically in FIG. 10, a sound or electromagnetic wave detector (54) and a sound or electromagnetic waves beam generator (52) are arranged such that the detector can detect the beam produced by the generator and reflected by the anode block (21', 21") (FIG. 10*a*). The moment at which the reference surface (21*a*', 21*a*") of an anode (20', 20") passes through the beam is detected when the anode block (21', 21") reflects all or part of the beam towards the detector (FIG. 10*b*). Trials have shown that the reflectivity of the surface of a new or spent anode is sufficient to enable satisfactory working of this embodiment. This embodiment is advantageous in that it allows the detector and the generator to be easily put together on a single positioning device (53).

The process according to the invention can be implemented using a measurement system comprising a position sensor (13*c*) to measure vertical distances traveled by a gripping device (13*a*) of an anode handling tool (13), a sound or electromagnetic waves beam generator (52) capable of producing at least one sound or electromagnetic waves beam (51) in a determined reference line or plane (50), at least one sound or electromagnetic wave detector (54) capable of detecting the passage of a determined part (21*a*, 21*a*', 21*a*") of an anode (20, 20', 20") through the beam and at least one positioning device (53) to which the generator and/or the detector are fixed. The position sensor (13*c*) is preferably integrated into the anode handling tool (13). The generator (52) typically comprises a source for each sound or electromagnetic waves beam (52). In the variant of the invention in which the beams are formed of electromagnetic waves, the generator advantageously includes at least one laser.

In one embodiment of the invention, the positioning device or each positioning device (53) in the measurement system is directly or indirectly fixed to or placed on a circulation aisle.

In another embodiment of the invention, the measurement system is integrated into a tending assembly (4) designed to be used for anode replacement operations. This embodiment of the invention facilitates displacement and positioning of the measurement system. It further allows for the measurements that are necessary for the positioning of a replacement anode to be made during the normal handling movements of the spent anode and of the replacement anode. The measurement system according to the invention is preferably integrated into the tending machine (6) of the tending assembly (4), and more preferably into the module (8) of the tending machine (6). In these cases, the sensor (13*c*) of the measurement system for determining the vertical position of the gripping device (13*a*) is typically the sensor fitted on the anode handling tool (13). In these variants, the positioning device or each positioning device (53) of the measurement system is directly or indirectly fixed to a tending assembly (4), a tending machine (6) or to a tending module (8).

The positioning device or each positioning device (53) of the measurement system is typically a telescopic arm or mast. When the measurement system is integrated into a tending assembly (4), the generator (52) and/or the detector (54) are typically fixed in the lower part of the positioning device (53).

Traveled distance measurements (A, B, C, A') can be made with or without action by an operator. For example, the detector can emit an electrical, light or sound signal when the determined reference surface of an anode passes through the beam(s) and an operator can record the value of the distance traveled by the gripping device given by the position sensor at the time that the signal is emitted. The distance A' corresponding to the position of the replacement anode can also be determined by an operator using values obtained for the first, second and third distances traveled (A, B and C). The distances (A, B, C, A') are advantageously entirely or partly measured by computer means, to simplify the task of operators and to avoid calculation mistakes. For example, passage of the anode reference surface (21*a*, 21*a*', 21*a*") through the beam can electrically or electronically trigger the position sensor measurement and recording of the corresponding distance. The measurement system advantageously comprises a device to record measurements made and to determine the vertical position of the replacement anode (20").

The generator (52) and the detector (54) can be located on the same positioning device (53) or on separate positioning devices. The generator (52) and the detector (54) could also be integrated into the same device.

What is claimed is:

1. Process for changing an anode of a cell for the production of aluminum by fused bath electrolysis, the cell comprising a plurality of anodes, at least one cathode block, and containing an electrolytic bath, each of said anodes comprising at least one anode block and a metal rod and being fixed removably by mechanical attachment means to a mobile metal frame, each said anode block having a reference surface, comprising the steps of:

establishing a reference line or plane using a beam of sound waves or electromagnetic waves;

selecting a spent anode for replacement by a replacement anode;

using at least one anode handling tool comprising a positioning device, a position sensor and a gripping device to grip the metal rod of the spent anode, and measuring with the position sensor a vertical distance A traveled by the gripping device in reaching a position in which the metal rod is gripped;

withdrawing the spent anode from the electrolytic cell, passing the anode block of the spent anode vertically through the beam and measuring with the position sensor a vertical distance B traveled by the gripping device at a moment when a reference surface of the spent anode passes through the beam;

gripping the metal rod of a replacement anode using a gripping device, passing the anode block of the replacement anode vertically through the beam and measuring with the position sensor a vertical distance C traveled by the gripping device at a moment when a reference surface of the replacement anode corresponding to the reference surface of the spent anode passes through the beam; and determining a desired vertical position of the replacement anode corresponding to the vertical position of the spent anode in the cell, from values obtained for the traveled distances A, B and C, and placing the replacement anode in the desired vertical position.

2. Process according to claim 1, wherein a single gripping device is used to handle both the spent anode and the replacement anode.

3. Process according to claim 1, wherein the anode reference surface is a lower surface of the anode block that will be immersed in the electrolytic bath contained in the electrolytic cell and that will be parallel to an upper surface of the cathode block.

4. Process according to claim 1, wherein the vertical distance B is measured during a downwards movement of the spent anode.

5. Process according to claim 1, wherein the vertical distance C is measured during an upwards movement of the replacement anode.

6. Process according to claim 1, wherein the vertical position of the replacement anode corresponds to a vertical distance A' traveled by the gripping device during said placing of the replacement anode.

7. Process according to claim 6, wherein the vertical distance A'=A−B+C+D, where D is a correction term to take account of the replacement anode reaching its normal operating rate in the cell.

8. Process according to claim 1, wherein the position sensor is integrated into the anode handling tool.

9. Process according to claim 1, wherein the anode handling tool is provided with a means for measuring the tension in the tool.

10. Process according to claim 9, wherein the means for measuring tension comprises an axial dynamometer.

11. Process according to claim 1, wherein the electromagnetic waves are selected from the group consisting of visible light, infrared radiation and radio waves.

12. Process according to claim 1, wherein the beam is generated using a laser.

13. Process according to claim 1, wherein the sound waves are ultrasound waves.

14. Process according to claim 1, wherein at least two beams of sound or electromagnetic waves are generated so as to form a reference plane.

15. Process according to claim 14, wherein each of said beams is generated by a distinct wave source.

16. Process according to claim 1, additionally comprising placing a sound or electromagnetic wave detector facing a sound or electromagnetic wave beam generator, such that the detector detects the beam produced by the generator and detects the moment when the reference surface of an anode passes through and interrupts the beam.

17. Process according to claim 1, additionally comprising placing a sound or electromagnetic wave detector and a sound or electromagnetic waves beam generator facing a reflecting surface, such that the detector detects the beam produced by the generator and reflected by the reflecting surface and detects the moment when the reference surface of an anode passes through the beam and interrupts the beam.

18. Process according to claim 1, additionally comprising placing a sound or electromagnetic wave detector and a sound or electromagnetic wave beam generator such that the detector can detect the beam produced by the generator and reflected by an anode block and detects the, moment when the reference surface of an anode passes through the beam, the anode block reflecting all or part of the beam towards the detector.

19. Process according to claim 1, wherein the reference line or plane is substantially horizontal.

20. Process according to claim 1, wherein the spent anodes are replaced sequentially by replacement anodes.

21. Process according to claim 1, wherein at least two spent anodes are replaced at the same time by replacement anodes.

* * * * *

UNITED STATES PATENT AND TRADEMARK OFFICE

CERTIFICATE OF CORRECTION

PATENT NO. : 7,422,675 B2
APPLICATION NO. : 11/212118
DATED : September 9, 2008
INVENTOR(S) : Alain Van Acker et al.

It is certified that error appears in the above-identified patent and that said Letters Patent is hereby corrected as shown below:

Cover page, after "(12) United States Patent", change "Acker et al" to --Van Acker et al--.

Signed and Sealed this

Twenty-first Day of October, 2008

JON W. DUDAS
*Director of the United States Patent and Trademark Office*